US008266999B1

(12) United States Patent
Sisemore et al.

(10) Patent No.: US 8,266,999 B1
(45) Date of Patent: Sep. 18, 2012

(54) MOBILE VERTICAL MISSILE LAUNCHER

(75) Inventors: Carl L. Sisemore, King George, VA (US); Myron Lyn Thomas, II, Fredericksburg, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 106 days.

(21) Appl. No.: 12/931,635

(22) Filed: Feb. 1, 2011

Related U.S. Application Data

(60) Provisional application No. 61/340,031, filed on Mar. 1, 2010.

(51) Int. Cl.
*F41F 3/04* (2006.01)

(52) U.S. Cl. ..... 89/1.815; 89/1.8; 244/3.1

(58) Field of Classification Search ..... 89/1.8–1.808, 89/1.811–1.82; 244/3.1
See application file for complete search history.

(56) References Cited

U.S. PATENT DOCUMENTS 5,341,142 A * 8/1994 Reis et al. ..... 342/64
5,682,005 A * 10/1997 Crowley ..... 89/1.815
5,847,307 A * 12/1998 Kennedy et al. ..... 89/1.817
6,526,860 B2 * 3/2003 Facciano et al. ..... 89/1.801
6,610,971 B1 * 8/2003 Crabtree ..... 244/3.1
6,748,845 B2 * 6/2004 Staiert et al. ..... 89/40.13
6,868,769 B1 * 3/2005 Wright ..... 89/1.811
2002/0148348 A1 * 10/2002 Staiert et al. ..... 89/40.02
2012/0037059 A1 * 2/2012 Brenner ..... 114/21.2
2012/0091259 A1 * 4/2012 Morris et al. ..... 244/17.13

* cited by examiner

*Primary Examiner* — Michael David
(74) *Attorney, Agent, or Firm* — Gerald W. Thielman, Esq.

(57) ABSTRACT

A mobile terrestrial vertical missile launch system is provided for relocatable ballistic missile deployment. The system is connectable to a transport truck and includes a trailer, a pivotable canister, a plurality of stabilizing legs, and an equipment module. The trailer has a hitch for connecting to the truck, a base for supporting wheels for road travel, and a flatbed platform having a transverse hinge. The canister contains launcher for at least one missile and is configurable by rotation at the hinge for disposal in either a longitudinal position for stowage or an erected position for deployment. The stabilizing legs are disposed along a periphery of the trailer. The legs can be disposed in one of an elevated position for stowage and a retarded position for ground engagement. The equipment container supplies electrical power, environmental conditioning, tracking, communication and control for the missile.

2 Claims, 3 Drawing Sheets

MOBILE VERTICAL MISSILE LAUNCHER

CROSS REFERENCE TO RELATED APPLICATION

Pursuant to 35 U.S.C. §119, the benefit of priority from provisional application 61/340,031, with a filing date of Mar. 1, 2010, is claimed for this non-provisional application.

STATEMENT OF GOVERNMENT INTEREST

The invention described was made in the performance of official duties by one or more employees of the Department of the Navy, and thus, the invention herein may be manufactured, used or licensed by or for the Government of the United States of America for governmental purposes without the payment of any royalties thereon or therefor.

BACKGROUND

The invention relates generally to vertical missile launchers. In particular, the invention relates to road-mobile launchers for surface-to-air intercept missiles.

Vertical missile launchers have conventionally been deployed aboard warships, such as cruisers and destroyers to replace rail launchers. Originally developed for anti-submarine warfare (e.g., ASROC, RUM-139), vertical launchers were subsequently deployed for other missiles for guidance using shipboard radar, such as Aegis. Missiles to be incorporated in ship-board vertical launcher arrays include Tomahawk (BGM-109) and Standard Missile. Of the latter, the SM-2 (RIM-67) and SM-3 (RIM-161) versions are used for surface-to-air interception of either hostile aircraft or ballistic warheads.

Conventional tactical surface-to-air missiles for are deployable on exposed ground-based launch stands. However, these involve deployment of several platforms for target detection, tracking, guidance and control.

SUMMARY

Conventional vertical missile launchers yield disadvantages addressed by various exemplary embodiments of the present invention. In particular, these designs provide such a launcher intended for relocatable ground transport.

Various exemplary embodiments provide a mobile terrestrial vertical missile launch system for relocatable ballistic missile deployment. The system is connectable to a transport truck and includes a trailer, a pivotable canister, a plurality of stabilizing legs, and an equipment module. The trailer has a hitch for connecting to the truck, a base for supporting wheels for road travel, and a flatbed platform having a transverse hinge.

In various embodiments the canister contains a launcher for at least one missile and is configurable by rotation at the hinge for disposal in either a longitudinal position for stowage or an erected position for deployment. The stabilizing legs are disposed along a periphery of the trailer. The legs can be disposed in one of an elevated position for stowage and a retarded position for ground engagement. The equipment container supplies electrical power, conditioning, communication and control for the missile.

BRIEF DESCRIPTION OF THE DRAWINGS

These and various other features and aspects of various exemplary embodiments will be readily understood with reference to the following detailed description taken in conjunction with the accompanying drawings, in which like or similar numbers are used throughout, and in which.

DETAILED DESCRIPTION

In the following detailed description of exemplary embodiments of the invention, reference is made to the accompanying drawings that form a part hereof, and in which is shown by way of illustration specific exemplary embodiments in which the invention may be practiced. These embodiments are described in sufficient detail to enable those skilled in the art to practice the invention. Other embodiments may be utilized, and logical, mechanical, and other changes may be made without departing from the spirit or scope of the present invention. The following detailed description is, therefore, not to be taken in a limiting sense, and the scope of the present invention is defined only by the appended claims.

Various exemplary embodiments provide a system for deploying a modular vertically launched missile launcher previously used exclusively in ship-board installations on a fully mobile land-based platform resulting in an expeditionary type missile launching system. The design incorporates a modular vertical missile launcher from which to house and launch the missiles, a trailer capable of transporting the launcher and all of its associated sub-systems such that the launcher and its sub-systems are an erected and enabled on the trailer and can then be quickly stowed and transported without removal from said trailer.

The Mk 41 Vertical Launching System (VLS) has been successfully used on numerous United States Navy and allied ships for many years. Policy considerations for implementing tactical ballistic missile defense have led to interest in extending the field of operations of this missile launching system to ground-based applications. One inherent characteristic for more effective security and cost-effective logistics involves having the missile launching system be readily mobile. While many mobile missile launching systems have been developed in the past, this is the first known application of incorporating an in-service Navy missile launcher onto a fully road-mobile, or expeditionary, land-based platform.

Figure 1:
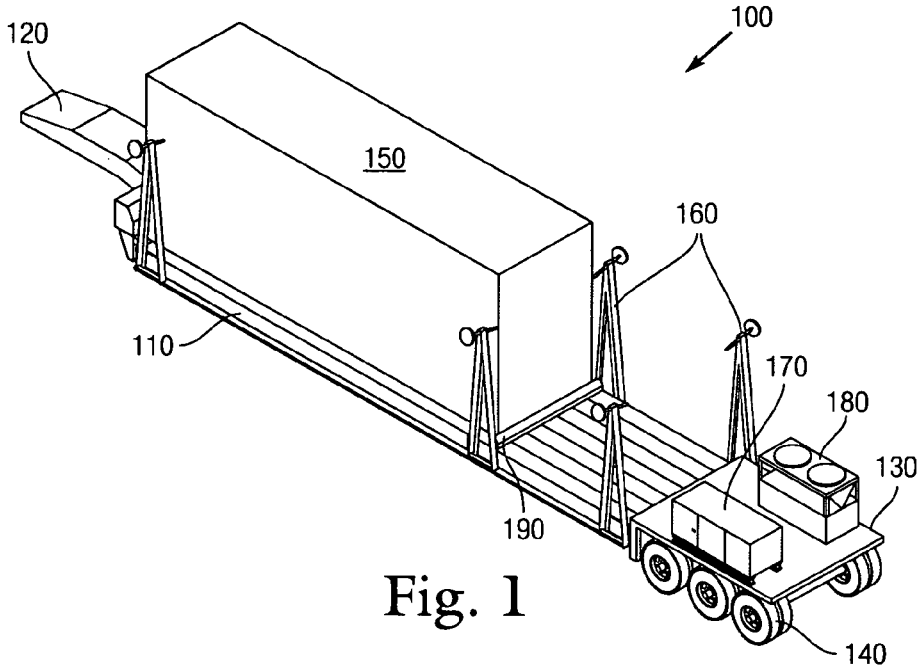
FIG. 1 is an assembly perspective view of a terrestrial-based vertical launcher.

FIG. 1 shows an assembly perspective view 100 of a launch system in the stowed configuration, appropriate for road-mobile towing. The launch system 100 includes a low flat-bed trailer 110 terminating at the longitudinal ends in a fore hitch 120 and an aft axle base 130 that support the wheels 140. A canister 150 lies horizontally disposed on the trailer 110 substantially parallel to the trailer's longitudinal axis. The canister 150 contains a launcher for at least one missile stored therein, such as an SM-3 for ballistic defense, in an armored or hardened case for protection against weather and other potentially debilitating threats. The canister 150 can correspond to the Mk 41 VLS or similarly configured system.

A plurality of stabilizing legs 160 terminating in ground-pads are disposed along the longitudinal periphery of the trailer 110, raised to extend upward substantially parallel to the sides of the canister 150 in the stowed configuration.

Equipment modules 170 for supplying electrical power and HVAC support, radar tracking and missile control systems 180, may be disposed on the base 130. A transverse hinge 190 disposed on the trailer 110 (perpendicular to the trailer's longitudinal axis) attaches to one edge of the canister 150 for pivoting. The trailer 110 enables the canister 150 and accompanying equipment to connect to a large motorized truck for travel across road for deployment that can be relocated at short notice.

Figure 2:
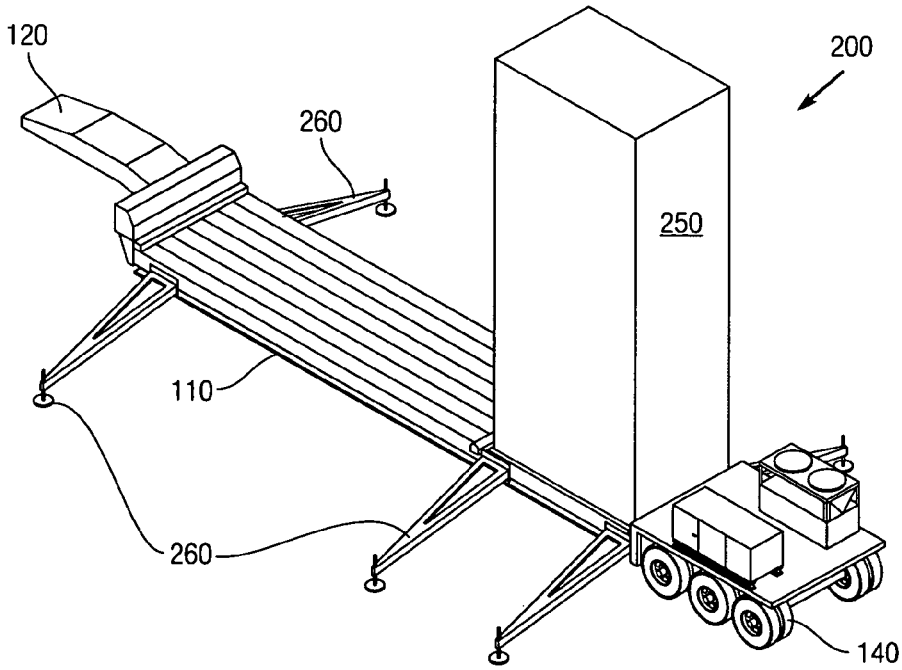
FIG. 2 is an assembly perspective view of the vertical launcher.

FIG. 2 shows a perspective view 200 of the launch system in the deployed configuration, appropriate for operational defense and target engagement. The canister 250 lies vertically disposed on the trailer 110, having been rotated on the hinge 190 upward and rearward for ballistic launch of the missile. The stabilizing legs 260 can be retarded or folded down to inhibit rocking of the trailer as weight shifts during deployment and missile launch. The legs 260 can be rotated from their stowed position at their junction to the trailer 110.

Figure 3:
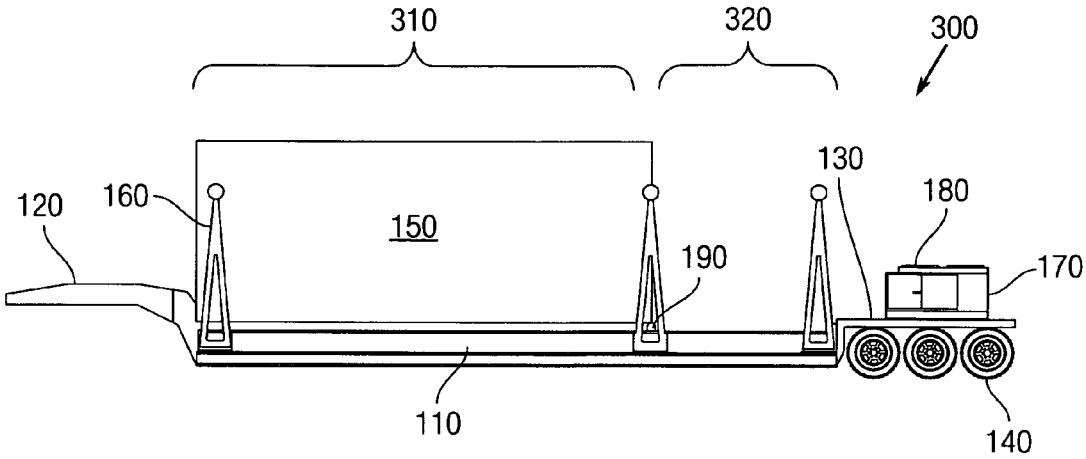
FIG. 3 is an assembly elevation view of the vertical launcher.

FIG. 3 shows an elevation view 300 of the launch system in the stowed configuration as shown from the port side. The canister 150 in the horizontal position occupies a flatbed fore portion 310 of the trailer 110, adjacent to the hitch 120. The mass of the canister 150 with the installed missile shifts the trailer's center-of-mass forward for improved road handling. A flatbed aft portion 320 of the trailer 110 can remain unoccupied during stowage. The stabilizing legs 160 are depicted as elevated for stowage. The upper edge of the canister 150 between the fore and aft portions 310 and 320 represents a deployed bottom free edge 330.

Figure 4:
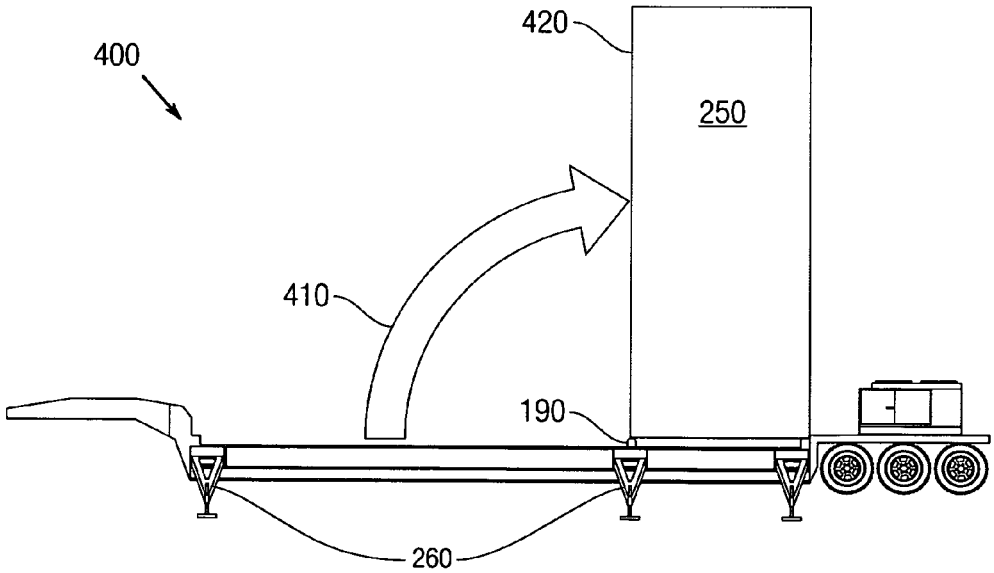
FIG. 4 is an assembly elevation view of the vertical launcher.

FIG. 4 shows an elevation view 400 of the launch system in the deployed configuration. The canister 250 in the vertical position has been rotated by arrow 410 (clockwise 90° from the port side) along the hinge 190. The legs 260 are deployed as being lowered for ground engagement. The wheels 140 at the base 130 can be elevated off the surface, depending on topographical conditions. The upper edge of the canister 250 between the fore and aft portions 310 and 320 represents a stowed bottom free edge 420.

A fore ledge on the hitch 120 can support one bottom free edge 420 of the canister 150 in the stowed configuration. An aft ledge on the base 130 can support the other bottom free edge 330 of the canister 250 in the deployed configuration. A motor within the equipment 170 can be used to rotate the canister from supine stowage as position 150 to erect deployment as position 250 and/or the legs from upright 160 to retard as deployed 260.

Figure 5:
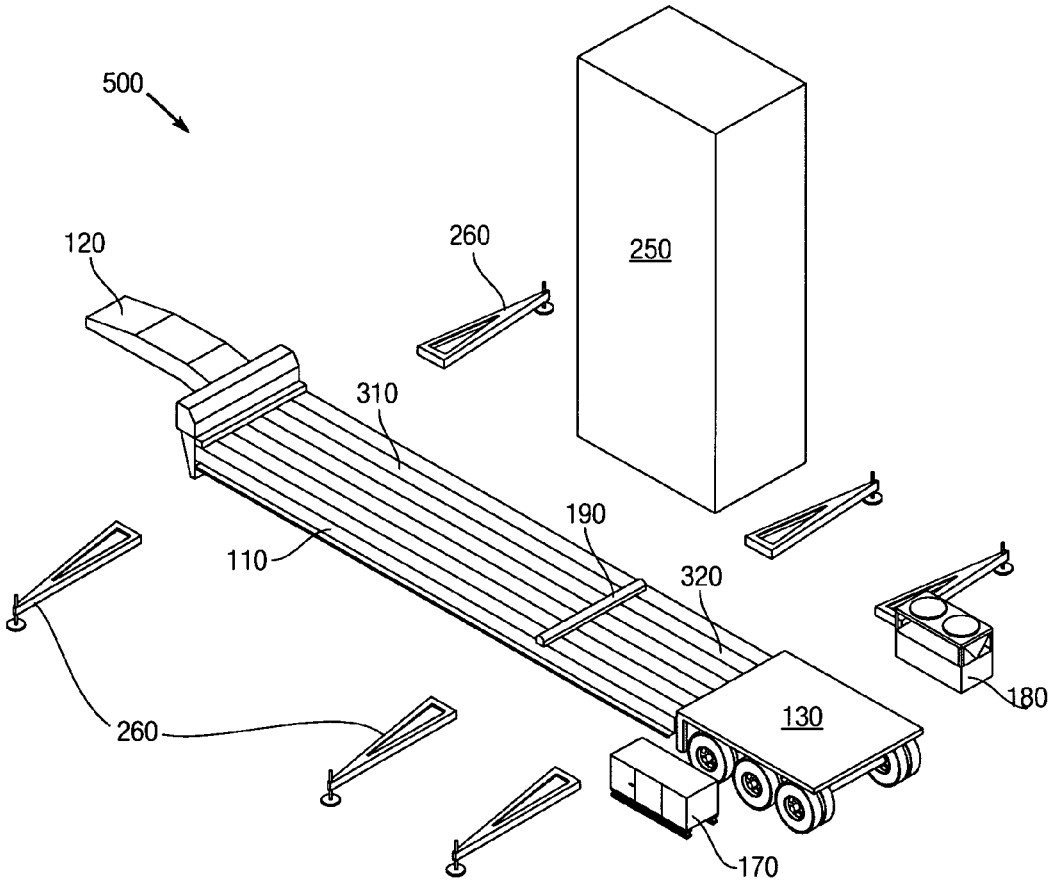
FIG. 5 is an exploded perspective view of the vertical launcher.

FIG. 5 shows an exploded perspective view 500 of the launch system for deployment. The trailer 110 includes the hitch 120, the flatbed with the fore and aft portions 310 and 320 divided by the hinge 190, and the base 130 containing the wheels 140. Adjacently separated from the trailer 110 for installation are the legs 260 and the canister 250 for deployment, along with the equipment 170 and radar system 180.

Various exemplary embodiments provide an expeditionary platform that can carry the Navy VLS in a stowed configuration along with all of its immediate sub-systems on a single towable unit or trailer for transport to a road-accessible launch site. Upon reaching the intended location, various exemplary embodiments provide erection and preparation for operations in a short period of time. Accomplishing this necessitates carrying all immediately necessary sub-systems on the same trailer or towable package as the launcher itself.

Various exemplary embodiments employ the existing Mk 41 VLS along with several other systems including: environmental conditioning (e.g., heating, ventilation, and air conditioning (HVAC), electrical power generation, fuel storage, pressurized water storage, electrical connection boxes, stabilizing jacks, armor plating, and mechanical erection devices to encompass a complete expeditionary VLS package.

The Mk 41 VLS has been in operation for many years and constitutes a modular, multi-purpose vertically oriented missile launcher capable of launching many Navy missiles installed aboard warships. Its conventional design inherently focuses around shipboard installation. The launcher has built-in electronics to operate and launch the missiles (albeit operating with ship-board power supply), a built-in gas management system to channel and direct missile exhaust away from the ship, and sufficient structure to store the missiles prior to launch.

However, because the Mk 41 VLS is designed to be installed in a warship, its design relies on numerous ship services including: electrical power, heating ventilation and air-conditioning (HVAC), and ballistic protection. Thus various exemplary embodiments have been developed to render the Mk 41 VLS independent of ship-board services by converting the launcher into a self-sufficient operating unit. For these embodiments, a separate command and control function can be assumed to remain external to the Mk 41 VLS mobile unit and communicate missile operational commands to the VLS module through an external data-communications interface.

Various exemplary embodiments are based on a custom-designed low-slung trailer arrangement where the primary long-bed of the trailer is positioned below the tops of the tires allowing for maximum overhead clearance. The Mk 41 VLS can be initially stowed in a horizontal configuration towards one end of the trailer. The Mk 41 VLS remains enclosed in an armored case that provides ballistic protection, anti-intrusion protection, and general protection from the environment. This armored case contains numerous access panels and doorways to enable personnel to install missiles, maintain equipment, and perform routine VLS related tasks.

Also integral to the armored skin is all of the necessary HVAC ducting to maintain internal temperature, humidity, and air quality for the system. All electrical, data, and communications connections can be conducted through one or more interface panels on the exterior of the armored case so that no access panels or doors remain open for an extended time during normal operation. The HVAC system, power generation unit, fuel storage units for the power generation unit, and fire suppression systems can be located at the two end of the trailer unit, either over the rear wheels or in the vicinity of the tongue or both.

For the trailer having been towed into desired position, integral support jacks can be deployed to stabilize the system to prevent vibration, tipping, or to correct for variations in site elevation. The Mk 41 VLS is then erected by pivoting it about a hinge pin located along the lower edge of the launcher connected to the trailer such that the launcher is rotated from a horizontal stowed configuration to a vertical deployed configuration. Erection of the launcher can either be accomplished through the use of an external crane system or preferably through a mechanical self-erection mechanism installed between the trailer and the launcher.

Once the launcher is fully erected it will need to be secured or latched to the trailer in the deployed configuration. HVAC, fire suppression, and power generation connections can either be made once the launcher is erected or some systems could be designed with sufficient flexibility in their connections to remain connected in both the stowed and deployed configuration. For services connected after erecting the launcher, all connections should preferably use ruggedized, flexible, quick-connect fittings and connectors to ensure a rapid set-up time. These aspects represent design considerations within the scope of the artisan of ordinary skill without departing from the scope of the invention.

The primary advantage to this system is the ability to take a previously ship-based missile launching system and incorporate it into highly mobile, rapid deployment land-based missile launching system. The inventive features of these exemplary embodiments include the incorporation of a ship-based system reliant on shipboard services into a self-contained land-based system.

While certain features of the embodiments of the invention have been illustrated as described herein, many modifications, substitutions, changes and equivalents will now occur to those skilled in the art. It is, therefore, to be understood that the appended claims are intended to cover all such modifications and changes as fall within the true spirit of the embodiments.

What is claimed is:

1. A mobile terrestrial vertical missile launch system for relocatable ballistic missile deployment, connectable to a transport truck, said system comprising:

a trailer having a hitch for connecting to the truck, a base for supporting wheels for road travel, and a flatbed platform having a transverse hinge;

a pivotable canister containing a launcher for at least one missile, said canister being configurable by rotation at said hinge for disposal in one of a longitudinal position for stowage and an erected position for deployment;

a plurality of stabilizing legs disposed along a periphery of said trailer, said legs being configured for disposal in one of an elevated position for stowage and a retarded position for ground engagement;

at least one equipment module for supplying electrical power, environmental conditioning, communication and control wherein said canister has a hardened case, said launcher houses said at least one missile, and said launcher further includes electronics for initiation of said missile.

2. The launch system according to claim 1, wherein said equipment module includes supply of target tracking for said missile.

* * * * *